US006124082A

United States Patent [19]

Edgar

[11] Patent Number: 6,124,082

[45] Date of Patent: Sep. 26, 2000

[54] SYSTEM AND METHOD FOR LATENT FILM RECOVERY IN ELECTRONIC FILM DEVELOPMENT

[75] Inventor: Albert D. Edgar, Austin, Tex.

[73] Assignee: Applied Science Fiction, Inc., Austin, Tex.

[21] Appl. No.: 09/291,735

[22] Filed: Apr. 14, 1999

Related U.S. Application Data

[62] Division of application No. 09/014,193, Jan. 27, 1998.
[60] Provisional application No. 60/036,988, Jan. 30, 1997.

[51] Int. Cl.[7] ..... G03C 7/30

[52] U.S. Cl. ..... 430/378; 430/363; 430/406; 430/407; 430/470

[58] Field of Search ..... 430/363, 378, 430/406, 407, 470

[56] References Cited

U.S. PATENT DOCUMENTS

| | | | |
|---|---|---|---|
| 3,520,689 | 7/1970 | Nagae et al. | 430/470 |
| 3,520,690 | 7/1970 | Nagae et al. | 430/470 |
| 3,615,479 | 10/1971 | Kohler et al. | 430/30 |
| 3,615,498 | 10/1971 | Arai et al. | 430/470 |
| 3,617,282 | 11/1971 | Bard et al. | 430/470 |
| 5,267,030 | 11/1993 | Giorgianni et al. | 358/527 |

*Primary Examiner*—Hoa Van Le
*Attorney, Agent, or Firm*—Dinsmore & Shohl LLP

[57] ABSTRACT

Recovering the dye image on film in electronic film development following a latent holding stage obviates the problem common in prior art electronic film development of film image destruction. Recovery of the image is accomplished using a developing agent containing couplers to form a dye image. These dyes do not affect the infrared scans of the image. Upon complete development of the dye image, further dye formation is halted by the application of a coupler blocking agent, while silver development and electronic scanning may continue or halt. After halting dye formation, the film is stable for an arbitrary time in a latent stage and may be dried and stored. Following this latent stage, silver is removed from the film with a bleach-fix leaving a conventionally usable film image.

21 Claims, 4 Drawing Sheets

SYSTEM AND METHOD FOR LATENT FILM RECOVERY IN ELECTRONIC FILM DEVELOPMENT

RELATED APPLICATION

This is a division of U.S. application Ser. No. 09/014,193, filed Jan. 27, 1998, now allowed, which claims the benefit of U.S. Provisional Application No. 60/036,988, filed Jan. 30, 1997.

FIELD OF THE INVENTION

This invention relates to the electronic development of film and more particularly to a system and method for recovering an image on film without destroying the film image.

BACKGROUND OF THE INVENTION

In conventional color film development, color film consists of multiple layers each sensitive to a different color of light. These layers contain grains of silver halide. Photons of colored light appropriate to each layer render the grains reducible to elemental silver upon the application of a developing agent. Contained within the primary developer for negative films and in the secondary color developer for reversal, or color positive, films are couplers that combine with the reaction products of the silver halide reduction and with other couplers contained in each layer to produce specific dyes within the film. These dyes form around the developing silver grains in the film and create dye clouds. Following color development, any remaining milky white unexposed silver halide is washed away in a "fix" solution and the reduced black grains of silver are washed away in a "bleach" bath. Usually the fix and bleach baths are combined into one. After all the silver is removed, a clear film remains with colored dye clouds articulating the colored image.

In a color negative film, the first and only developer contains couplers to form a negative dye image at the same time as the negative silver image develops. The bleach-fix bath then removes both the developed silver and the undeveloped silver halide leaving only the negative color dye image. In color positive film, sometimes called transparency or reversal film, the first developer does not contain couplers. This first developer uses up the exposed silver halide in areas of the film that were exposed leaving silver halide in areas of the film that were not exposed. This remaining silver halide is rendered developable either by exposing it to bright light or to a fogging chemical. A second developer that does contain couplers then reduces this remaining silver halide to silver producing at the same time a dye image. The silver halide remains, and the dyes form, in areas of the film that did not receive light while no silver halide remains, and therefore no dyes form, in areas of the film that had originally received light. Thus, a positive image is formed for direct viewing following the fix and bleach steps.

In electronic film development (a method of developing film without forming dyes), the developing film is scanned at a certain time interval using infrared light so as not to fog the developing film, and also to see through antihalation layers. During development, color is derived from a silver image by taking advantage of the milky opacity of unfixed silver halide to optically separate the three color layers sensitive to blue, green, and red. This application will follow a convention of referring to the top of the three layers of the film as the "front" and the bottom layer closest to the substrate as the "back" or "rear." Viewed from the front during development, the front layer is seen clearly, while the lower layers are substantially occluded by the milky opacity of the front layer. Viewed from the rear during development, the back layer is seen, while the other layers are mostly occluded. Finally, when viewed with transmitted light, the fraction of light that does penetrate all three layers is modulated by all, and so contains a view of all three layers. If the exposures of "front", "back", and "through" views were mapped directly to yellow, cyan and magenta dyes, a pastelized color image would result. However, in digital development these three scans, "front", "back" and "through", are processed digitally using color space conversion to recover full color.

One problem with prior methods of electronic film development is that the film is typically consumed in the process. Because the developer chemicals used during typical electronic film development do not contain couplers, color dye clouds are not formed in the film. The lack of dye clouds renders the film useless once the traditional electronic film development process is complete. The present invention addresses this problem by providing a conventional color negative as a byproduct of electronic film development.

SUMMARY OF THE INVENTION

The present invention provides for the electronic scanning of a silver image on a color sensitive film while exposed to a developing agent. The developing agent contains couplers which form a dye image from the silver image. The light used during electronic scanning is chosen to be substantially unaffected by the dye image. Once the dye image has completely developed, further formation of the dye image is halted.

DETAILED DESCRIPTION

Figure 1A:
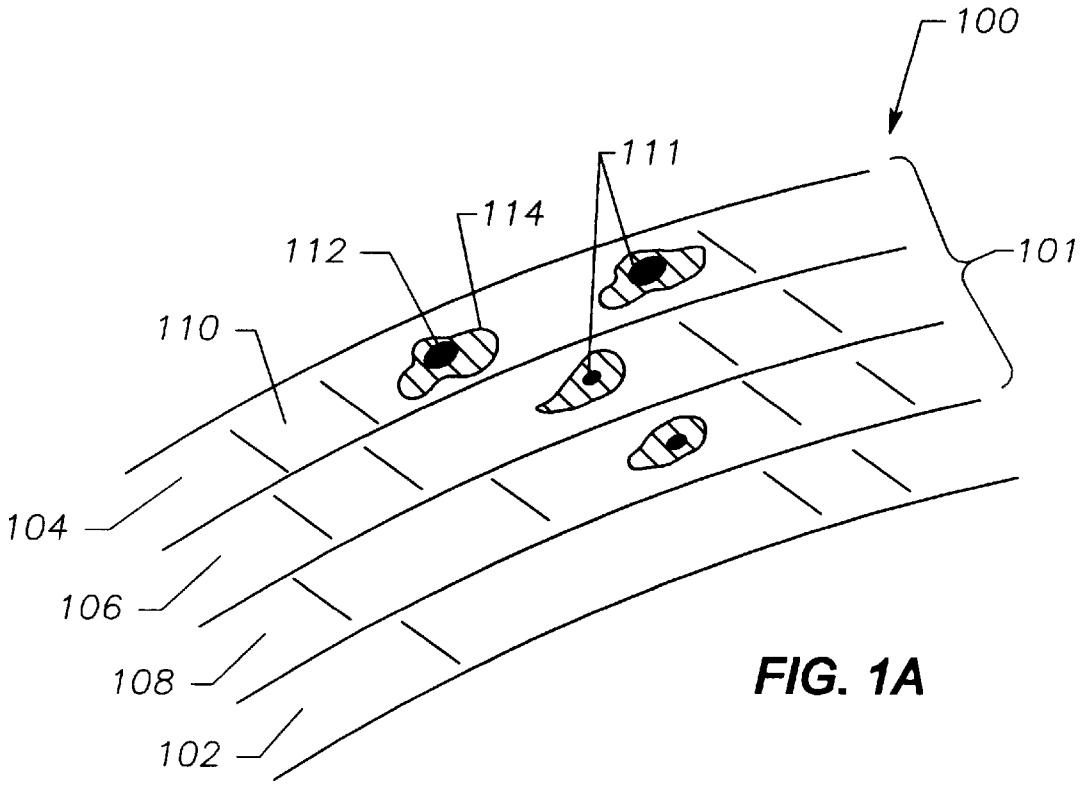
FIG. 1A is a cross-sectional view of the layers in color film and depicts the formation of dye clouds during the development process.

Turning now to FIG. 1A, a more detailed description of the key features of the present invention is provided. FIG. 1A shows a cross-sectional view of a film 100 which consists of a film base 102 over which a multi-layered emulsion 101 is coated. This emulsion is simplified for illustration purposes to have just three layers, 104, 106 and 108, each sensitive to one of the primary colors blue, green, and red, respectively. The emulsion 101 is typically made of gelatin mixed with a milky cloud of silver halide 110. The silver halide 110 is divided into grains 111 which are embedded in each color sensitive layer 104, 106 and 108 of the emulsion 101. When the grains 111 are exposed to light corresponding to the color to which the layer is sensitive, the grains 111 in that layer are rendered developable and are reduced to elemental silver.

One such grain 112 has been exposed and reduced to elemental silver by the action of the developer. This grain 112 now appears as a black grain. The byproducts released by the reaction of the developer with the silver halide combine with other chemicals in the developer that are precursors to color dyes (here called couplers) and with additional couplers manufactured into and unique to each layer to form dyes. These dyes typically form within a several micron diffusion distance around the silver grain 112 to produce what is called a dye cloud 114. The color of the dye depends on the couplers located within and unique to each layer of emulsion 101, and are arranged so the blue sensitive layer 104 develops yellow dye clouds, the green sensitive layer 106 develops magenta dye clouds, and the red sensitive layer 108 develops cyan dye clouds.

Figure 1B:
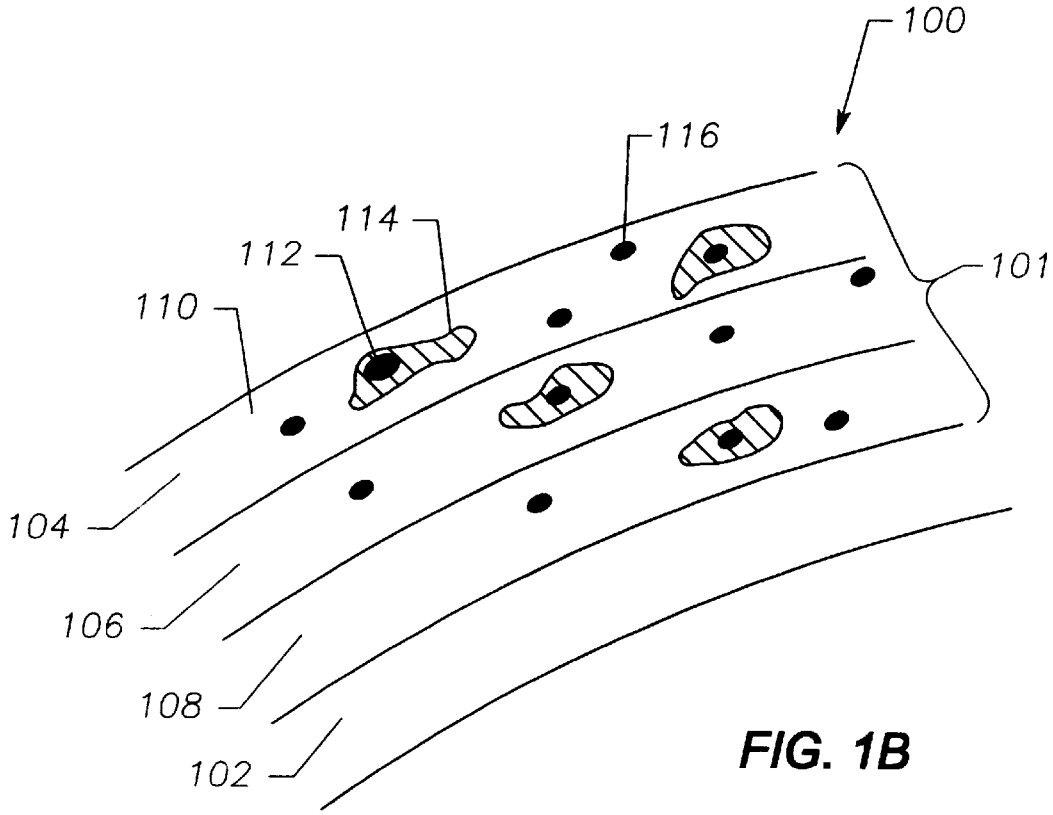
FIG. 1B is a cross-sectional view of the film shown in FIG. 1A undergoing further development without couplers.

Another feature important to the present invention is illustrated in FIG. 1B. FIG. 1B shows a film 100 after it has been developed as described above in conjunction with FIG. 1A. Next, the film 100 is placed in a developer without the couplers. As a result of this second developer application, grains 116 in the emulsion 101 will continue to develop to elemental silver; however, there will be no corresponding formation of dye clouds due to the lack of couplers. These grains 116 will be visible to the electronic film developing process but will leave no dye to add to the image after the silver is dissolved and washed away.

Figure 2:
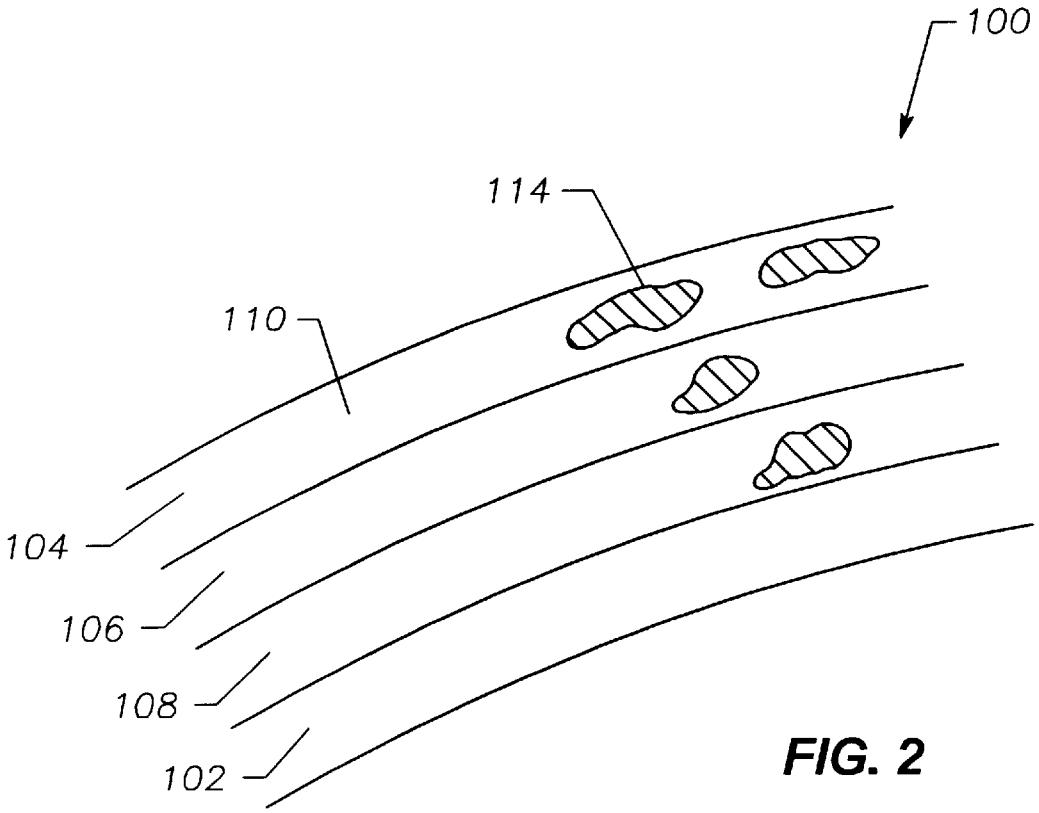
FIG. 2 is a cross-sectional view of the film shown in FIG. 1A or FIG. 1B showing how dye clouds are isolated in color film fixing.

FIG. 2 illustrates a film 100 after a development process as previously described and from which the unexposed silver halide has been removed by a chemical (such as sodium thiosulfate). Such a chemical is commonly called a "fix". In addition, the elemental silver grains have been removed by another chemical commonly called a "bleach". The fix and bleach are typically combined in one solution, sometimes referred to as a "blix". Thus, the application of a fix and bleach isolates any dye clouds 114 in the film 100. It is important to note that at this point in the process, the same dye image would be produced if the film had only been exposed to the color developer described in conjunction with FIG. 1A as would result from further exposure to a second developer containing no coupler as described in FIG. 1B. This is due to the fact that only the dye clouds 114 remain after the blix has been applied to the film 100.

Figure 3:
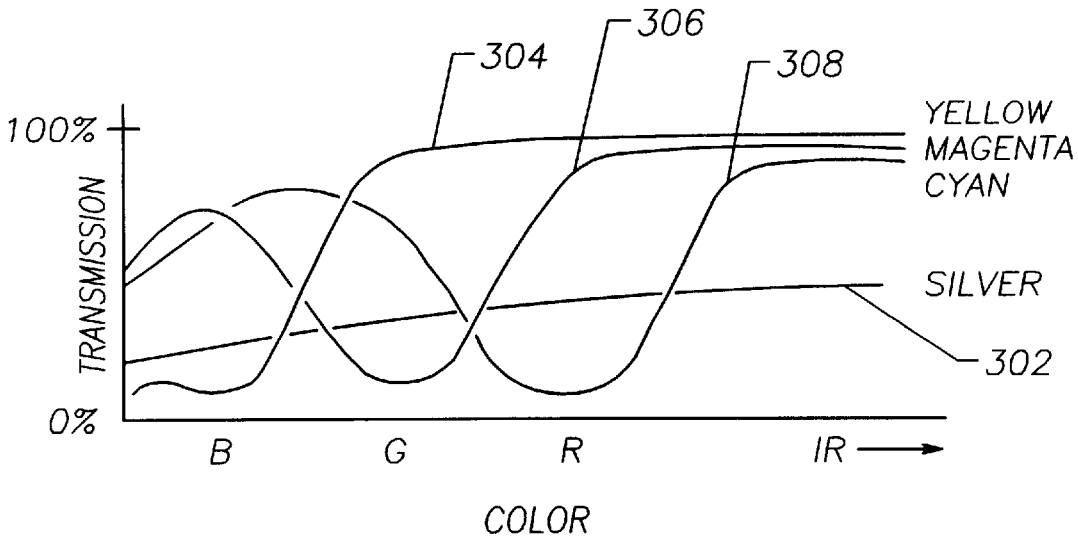
FIG. 3 is a graph depicting the spectral absorption of various dyes and silver grains.

FIG. 3 charts the spectral absorption of typical dyes and of elemental silver by showing the transmission of different colors of light by various dyes and silver. Curve 302 in FIG. 3 shows that the elemental silver image absorbs all colors. This is why such an image is called a black and white image, and it must be bleached away before the colored dye image can be usefully seen. FIG. 3 also illustrates that only the elemental silver image absorbs infrared light thereby modulating that light into a scannable image. Under infrared light, the dyes used in film processing do not absorb the light, and are therefore undetectable in a scannable image as evidenced by curves 304, 306 and 308. This is important because it means that electronic film development conducted under infrared light can receive scans of the developing silver image completely independent of the formation of specific dyes. The dye clouds simply have no effect on an electronic film development scan if that scan is made at an infrared wavelength longer than about 780 nanometers. Thus, couplers can be added to a developer to form dye clouds without affecting the scans of electronic film development conducted under infrared light.

Figure 4:
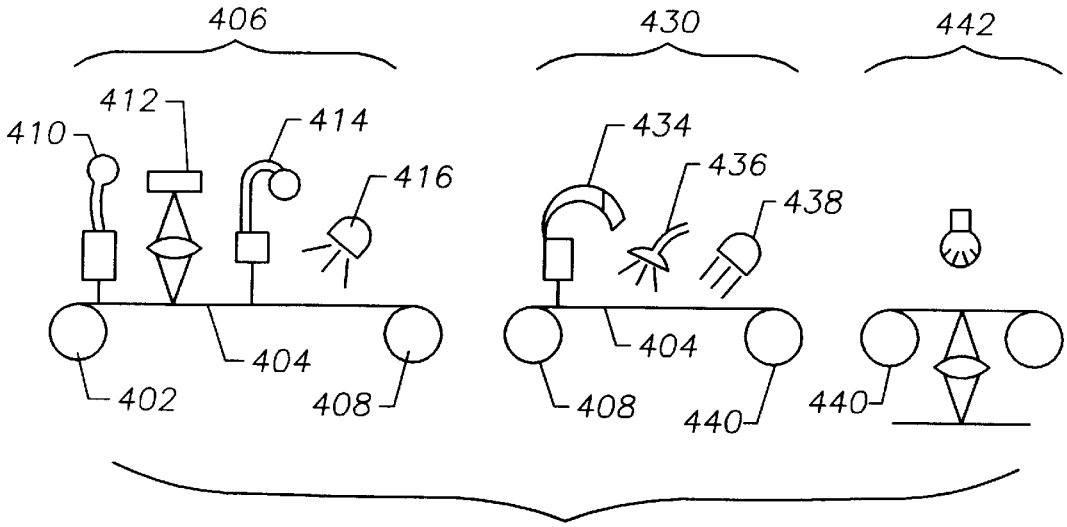
FIG. 4 is a perspective view of the system of the present invention.

FIG. 4 discloses a system which includes stations for both electronic film development and the cessation of dye coupler development. A feed spool 402 feeds a film 404 containing an image through an electronic film developer 406 and onto a takeup spool 408. Station 410 applies a controlled amount of developer to the film 404. The applied developer includes color couplers. Such a developer is commonly available as the developer in the "C-41" process suite of chemicals manufactured by Eastman Kodak Company of Rochester, N.Y., among others. The film 404 with the applied developer advances to the infrared scanning station 412 which operates in accordance with the teachings of electronic film development such as the process described in U.S. Pat. No. 5,519,510 issued to Edgar, the present inventor. There may be several such scanning stations 412, but only one has been illustrated for simplicity. Immediately following the last scanning station 412, further dye coupling is halted by applying a solution at station 414 that prevents further film development. One such solution is a 3% acetic acid wash although others are commonly used in the industry. The advancing film 404 is dried at drying station 416 before being rolled up on spool 408 for storage.

After passing through the electronic film developer 406, the film 404 has a conventional dye image embedded in it which is masked by a combination of silver halide and silver grains. From this point on in the process, the system operator may choose to retrieve the film image by mounting the spool 408 on a fixer 430. In the fixer 430, the film 404, having undergone the process described thus far in connection with FIG. 4, is advanced by station 434 for application of a bleach fix solution. As earlier described, the bleach fix removes the unexposed silver halide and elemental silver grains from the film 404. This solution is commonly available as the bleach-fix in the "C-41" process suite of chemicals manufactured by Photocolor Corporation and others. Rinsing station 436 washes off the bleach fix, and station 438 dries the film 404 before it is wrapped onto spool 440 for storage. Film spool 440 can then be mounted on a conventional optical printer 442, a conventional scanner, a viewer, a sleever machine to put the film into sleeves for longer storage, or on any device receiving normally processed film.

It should be noted that the fixer 430 can be manually operated by a user without the skills necessary to run a home darkroom. First, the film 404 is already developed and will not be affected by exposure to additional light, so no darkroom or dark tent is needed. Second, the application of bleach fix in this process is done to completion (i.e., until all remaining grains are removed), so precise timing and temperature control is not needed. When applying the bleach fix manually, the operator wraps the film around a spiral film reel such as that available from Kindermann and other manufacturers sold in camera shops. Then, the reel and film are submersed for several minutes in the bleach-fix at room temperature. Next, the spiral film reel is rinsed for a few minutes under running tap water, and then the film is hung up to dry. All of these steps may be performed in normal room light. The problem with environmental contamination from the silver remains the same as for conventional home darkrooms. As an alternative, the film may be returned to a commercial lab for the bleach fix step and printing.

As previously described, a single scanning station 412 is shown in FIG. 4 for simplicity. In accordance with the teachings of electronic film development, several such stations may be employed to scan the film at different stages of film development as further described in U.S. Pat. No. 5,519,510. In FIG. 4, the last of these stages is shown placed before development is halted at station 414; however, a scanning station could also be placed after development is halted at station 414. With that said, for reasons of uniformity, it has been found that scanner 412 is best placed as close as possible to, but just before station 414. A limitation in the system of FIG. 4 is that the last electronic film developer scan is made coincident with the "normal" development of the film. With this first disclosed system, it is thus possible to get both an underdeveloped, or "pulled," record of electronic film development and a normally developed record, but not an overdeveloped, or "pushed," record. The system shown in FIG. 5 removes this limitation.

Figure 5:
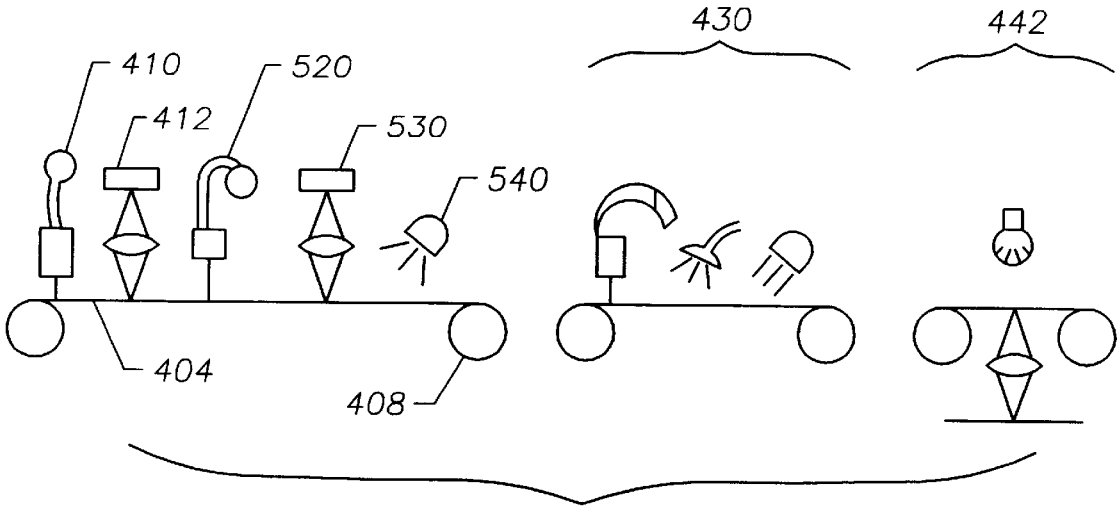
FIG. 5 is a perspective view of an alternate embodiment of the system shown in FIG. 4.

FIG. 5 shows an alternate embodiment from FIG. 4 wherein the coupler halting solution applied at station 414 in FIG. 4 that terminates all development is replaced with a coupler halting solution that does not completely halt color development. This solution is applied at station 520 in FIG. 5. One such solution is a developer, such as HC-110 manufactured by Eastman Kodak Company, that does not contain couplers, and is applied in sufficient quantity to wash off the first developer that did contain couplers. In addition this second developer can be more concentrated or caustic to encourage shadow grains to develop. Another alternative is to apply a solution that does not interfere with the development but which blocks the further formation of dyes.

After color coupling is halted by the solution applied at station 520, color development ceases while development of the silver image continues. Scanning station 530 receives the overdeveloped record and reveals more shadow detail than would have been present in a normally developed film. In accordance with the methods of electronic film processing in general, this shadow detail can be combined with the normal and underdeveloped scans to produce a superior image. Following station 530, the developer can be dried on the film 404 and the film stored on spool 408. It does not matter after this point if the film 404 is exposed to light or if development continues slowly so long as no more dye forms. Any silver fog or chemical residue can be cleared in the subsequent fixing apparatus 430 to produce a negative that is optically printable with apparatus 442.

In a variation of FIG. 5, a developer which has no color couplers may be applied at station 410. This enables the production of a latent positive film. An example of this type of developer could be the first developer used in standard reversal processing, available from Eastman Kodak Company as the first developer in the "E6" suite of chemicals. The addition or omission of couplers to the film 404 makes no difference to the electronic film development scanning station 412. After normal development and at the time the reversal film would normally go through fogging and a second color developer, a developer containing couplers may be applied at station 520. The developer with couplers could actually consist of the first developer already on the film, with only the couplers themselves added by station 520. Alternatively, it may be desirable to alter or accelerate the developer action at this point in the process by adding additional chemicals. The goal at this point for forming the dye image is to render all remaining undeveloped silver halide developable into silver thereby simultaneously forming the dye image. Traditionally, the film is fogged before the second developer with couplers is applied, but it makes no difference to the final product in what order the remaining silver halide is reduced. In particular, it makes no difference to the end product if silver halide related to the negative image is developed first, and that not related to the image developed later. In fact, the last of the silver halide can be reduced months later so long as it is eventually reduced. By not fogging the film first, the system of FIG. 5 will continue negative development of the film with the developer containing couplers applied at station 520 to allow scanning station 530 to produce the overdeveloped scan that electronic film development uses to extract more detail from the shadows.

After the final scan at station 530, the film is fogged by lamp 540 such that the second developer completes the reduction of any remaining silver halide to produce the positive dye image. The remainder of the storage and fixing process is the same as that previously described for FIG. 5. The fogging of the film with lamp 540 and the completion of development thereafter alternatively could be moved to the fixing stage 430 and performed only if the latent film is finished.

Figure 6:
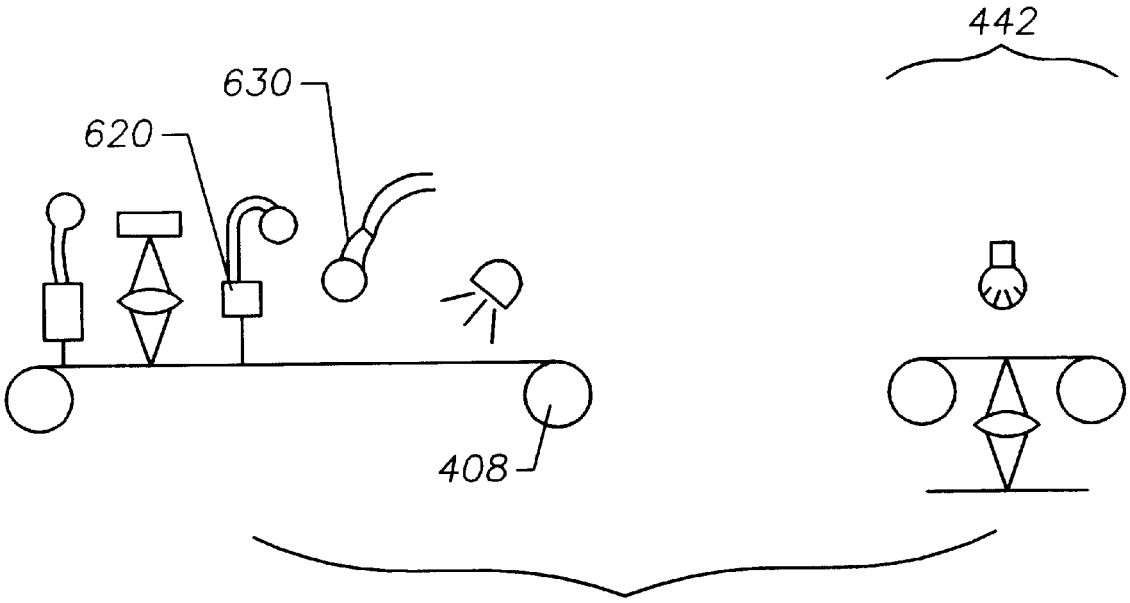
FIG. 6 is a perspective view of an alternate embodiment of the system shown in FIG. 5.

The procedures described so far produce, as an intermediate step, a latent film that may be stored and then either finished into a normal film or discarded at a later time. Commercial labs may wish to incorporate the finishing steps into a single process as shown in FIG. 6. In FIG. 6, station 620 applies a development halting solution that is typically a bleach fix as previously described. This can be done if sufficient bleach fix is applied or washed to stop development quickly; otherwise, a dye stain will result. An alternate arrangement would be to add another station just prior to station 620 in order to halt development with a "stop bath" of 2% acetic acid. After fixing, the bleach fix is washed from the film at wash station 630. The effluent from this wash must be treated in accordance with environmental laws, as is currently done by commercial labs. The film is then dried and stored as a conventional negative on spool 408, and is ready for subsequent optical printing at station 442 or any other process that can be performed on conventional film.

While this invention has been described with an emphasis upon certain preferred embodiments, variations in the preferred system and method may be used and the embodiments may be practiced otherwise than as specifically described herein. Accordingly, the invention as defined by the following claims includes all modifications encompassed within the spirit and scope thereof.

What is claimed is:

1. A method for latent film recovery in electronic film development comprising:

exposing a color sensitive film containing silver halide to a first developing agent containing no couplers;

forming a silver image from interaction between the first developing agent and the film;

electronically scanning the film;

applying couplers to the film after a development time; and reducing the silver halide to silver in the presence of the couplers to form a dye image.

2. The method of claim 1 wherein the light is infrared.

3. The method of claim 2 further comprising halting further formation of the dye image when the dye image is complete.

4. The method of claim 3 wherein the halting step comprises applying a coupler blocking agent to the film.

5. The method of claim 4 wherein the coupler blocking agent also halts formation of the silver image.

6. The method of claim 5 wherein the coupler blocking agent is an acetic stop bath.

7. The method of claim 4 wherein the coupler blocking agent rinses the first developing agent from the film.

8. The method of claim 7 wherein the coupler blocking agent is a wash.

9. The method of claim 7 wherein the coupler blocking agent is a second developing agent free of couplers that displaces the first developing agent on the film.

10. The method of claim 4 wherein the coupler blocking agent does not halt the formation of the silver image by the first developing agent.

11. The method of claim 4 wherein the formation of the silver image continues after the applying step.

12. The method of claim 11 further comprising electronically scanning the film image a second time after the applying step.

13. The method of claim 4 further comprising removing silver from the film after the applying step.

14. The method of claim 13 wherein the removing step comprises applying a fixing solution to the film.

15. The method of claim 14 wherein the fixing solution halts further formation of the dye image.

16. The method of claim 14 wherein the fixing solution is a bleach-fix which removes both developed silver and undeveloped silver from the film.

17. The method of claim 16 wherein the bleach-fix comprises a first and a second solution, wherein the first solution removes undeveloped silver from the film, and the second solution removes developed silver from the film.

18. The method of claim 13 further comprising waiting a period of time between the halting and the removing steps.

19. The method of claim 18 further comprising drying the film between the halting and the removing steps.

20. The method of claim 19 further comprising storing the film between the halting and the removing steps.

21. The method of claim 20 further comprising optically printing the film after the removing step.

* * * * *